US009266336B1

(12) United States Patent
Jacobs et al.

(10) Patent No.: US 9,266,336 B1
(45) Date of Patent: Feb. 23, 2016

(54) INK BARRIER FORMED ON PRINTHEAD TO PREVENT AIR INTAKE

(71) Applicant: Xerox Corporation, Norwalk, CT (US)

(72) Inventors: Robert M. Jacobs, Tigard, OR (US); Reid W. Gunnell, Wilsonville, OR (US); Brian J. Daniels, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/680,814

(22) Filed: Apr. 7, 2015

(51) Int. Cl.

| | |
|---|---|
| ***B41J 1/14*** | (2006.01) |
| ***B41J 2/16*** | (2006.01) |
| ***B41J 2/165*** | (2006.01) |
| ***B41J 2/14*** | (2006.01) |

(52) U.S. Cl.
CPC ..... *B41J 2/16538* (2013.01); *B41J 2/1433* (2013.01)

(58) Field of Classification Search
CPC .. B41J 2/1652; B41J 2/16535; B41J 2/16552; B41J 2/16538; B41J 2/16505; B41J 2/16547; B41J 2/1707; B41J 2/1714; B41J 2/16544; B41J 2/1721
See application file for complete search history.

(56) References Cited

U.S. PATENT DOCUMENTS

| | | | | |
|---|---|---|---|---|
| 5,027,134 | A | 6/1991 | Harmon et al. | |
| 5,146,243 | A | 9/1992 | English et al. | |
| 5,635,965 | A | 6/1997 | Purwins et al. | |
| 5,963,228 | A | 10/1999 | Purwins | |
| 6,623,098 | B2 | 9/2003 | Davis | |
| 6,742,860 | B2 | 6/2004 | Harper | |
| 7,690,756 | B2 | 4/2010 | Takagi | |
| 8,182,062 | B2 * | 5/2012 | Inoue | B41J 2/16538 347/33 |
| 2005/0007411 | A1 | 1/2005 | Tee et al. | |

* cited by examiner

*Primary Examiner* — Juanita D Jackson
(74) *Attorney, Agent, or Firm* — Maginot Moore & Beck LLP

(57) ABSTRACT

An imaging device includes at least one printhead including an aperture plate defining a plurality of apertures, an ink plate and a controller. The at least one printhead is configured to eject liquid ink through the plurality of apertures of the aperture plate. The ink plate is positioned with reference to the aperture plate to enable an ink layer to form between the ink plate and the aperture plate by ink ejected by the printhead. The controller operatively connected to the printhead and configured to operate the printhead to eject the liquid ink to the ink plate to form the link layer.

17 Claims, 6 Drawing Sheets

INK BARRIER FORMED ON PRINTHEAD TO PREVENT AIR INTAKE

TECHNICAL FIELD

This disclosure relates generally to printheads of an inkjet imaging device, and, in particular, to methods for preventing air and other debris from entering such printheads.

BACKGROUND

A typical inkjet printer typically uses a printhead assembly that includes one or more printheads. Each printhead has a plurality of inkjets from which drops of ink are ejected towards a recording medium. The inkjets of a printhead receive the ink from an ink manifold in the printhead that is supplied ink from a source, such as an ink reservoir or an ink cartridge. Each inkjet also includes an actuator positioned opposite an orifice, or nozzle, through which drops of ink are ejected. The nozzles of the inkjets may be formed in an aperture, or nozzle, plate that has openings corresponding to the nozzles of the inkjets. During operation, drop ejecting signals activate the actuators in the inkjets to expel drops of fluid through the inkjet nozzles onto the recording medium. By selectively activating the actuators of the inkjets to eject drops as the recording medium and printhead assembly move relative to each other, the deposited drops can be precisely patterned to form particular text and graphic images on the recording medium.

One difficulty faced by inkjet systems is the risk of sucking air or other contaminants, such as dust and paper fibers, into the printhead through the inkjet nozzles. These contaminants disrupt the fluidic path for the ink through the printhead. Such disruption from the air or contaminants can result in missing, undersized or misdirected drops on the recording media that degrade the print quality during printer operation, and even render one or more inkjets in the printhead completely inoperable. Air and other contaminants may enter the printhead nozzles in many situations. For example, negative pressures may develop within the printhead resulting in air being drawn in through the nozzles when the printhead is subjected to a sudden external impact or jolt, or when a hose is disconnected upstream of the printhead. In another example, negative pressure develops due to changing pressures in the external environment, such as when the printer is shipped in a shipping container. Consequently, printer improvements that help prevent air and other contaminants from entering a printhead are desirable.

SUMMARY

An imaging device that helps prevent air and other contaminants from entering a printhead includes a printhead including an aperture plate defining a plurality of apertures, the printhead configured to emit liquid ink through the plurality of apertures of the aperture plate, a plate positioned with reference to the aperture plate to enable a liquid ink layer to form between the plate and the aperture plate with ink emitted from the printhead, and a controller operatively connected to the printhead and configured to operate the printhead to emit the liquid ink to the plate to form the ink layer.

A method of operating an imaging device helps prevent air and other contaminants from entering a printhead in the device. The method includes positioning at least one of a printhead and a plate with reference to each other at a distance to enable an ink layer to be formed between an aperture plate of the printhead and the plate with liquid ink emitted by the printhead, and operating with a controller the printhead to emit liquid ink through a plurality of apertures defined in the aperture plate of the printhead to the plate to form the ink layer between the plate and the aperture plate.

BRIEF DESCRIPTION OF THE DRAWINGS

The foregoing aspects and other features of the present disclosure are explained in the following description, taken in connection with the accompanying drawings.

DETAILED DESCRIPTION

Figure 1:
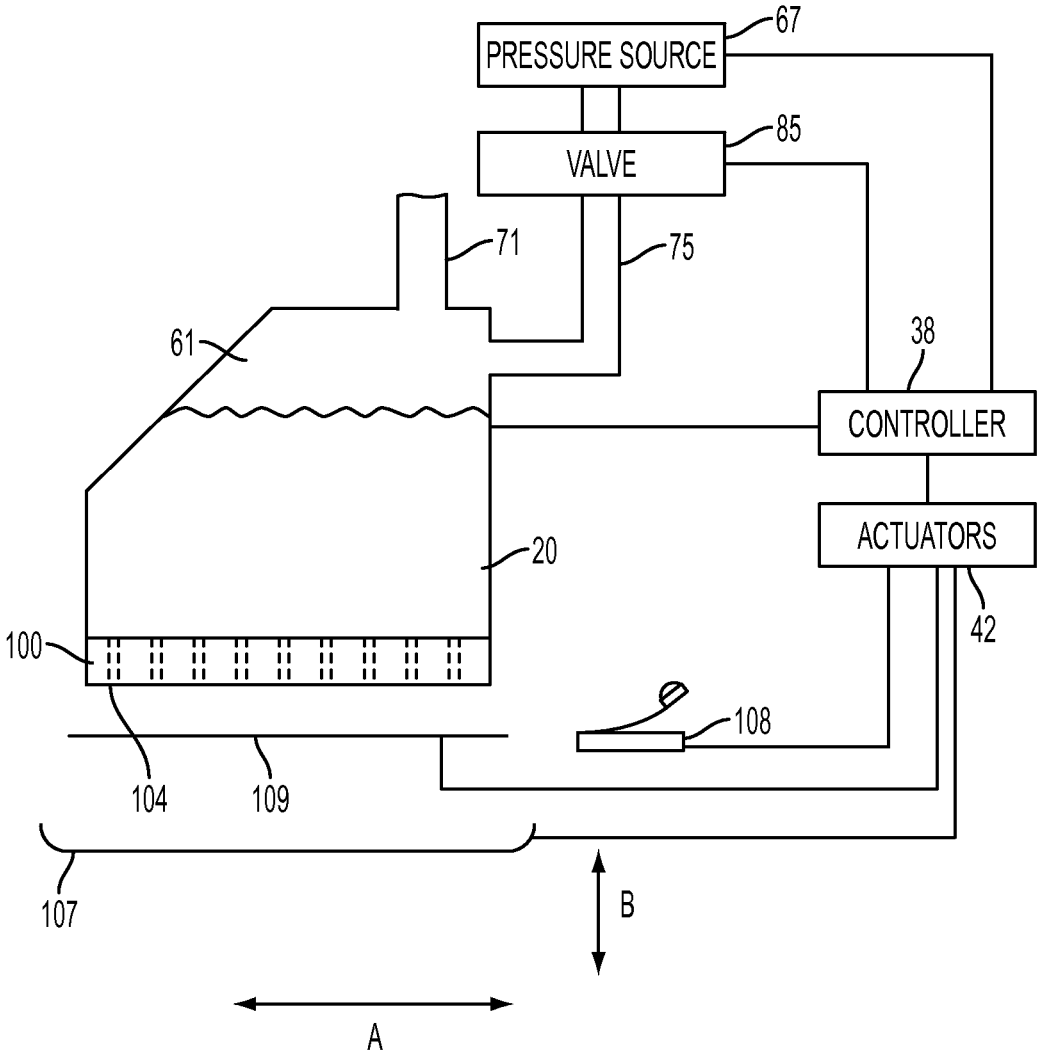
FIG. 1 is a simplified side cross-sectional view of an embodiment of a printhead positioned by a plate, receptacle and wiper blade.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by a marking engine and may include text, graphics, pictures, and the like. As used herein, the process direction is the direction in which an image receiving surface, e.g., media sheet, web, or intermediate transfer drum or belt, moves through the imaging device. The cross-process direction, along the same plane as the image receiving surface, is substantially perpendicular to the process direction.

Figure 5:
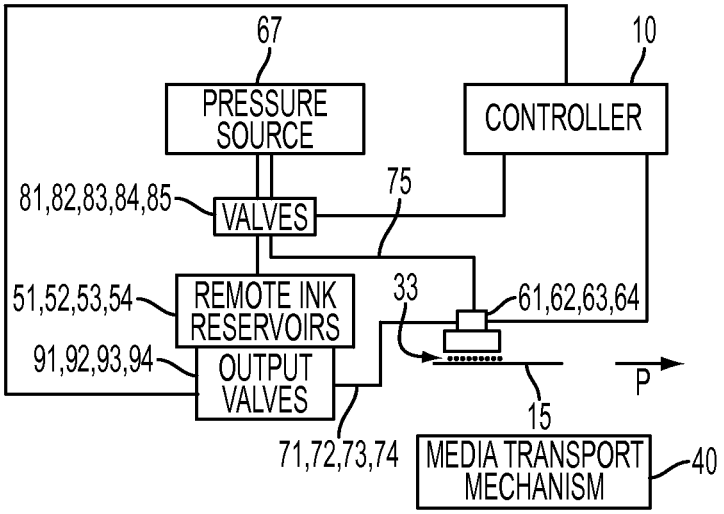
FIG. 5 PRIOR ART
FIG. 5 is a schematic block diagram of an embodiment of a prior art inkjet printing apparatus that includes on-board ink reservoirs.
Figure 6:
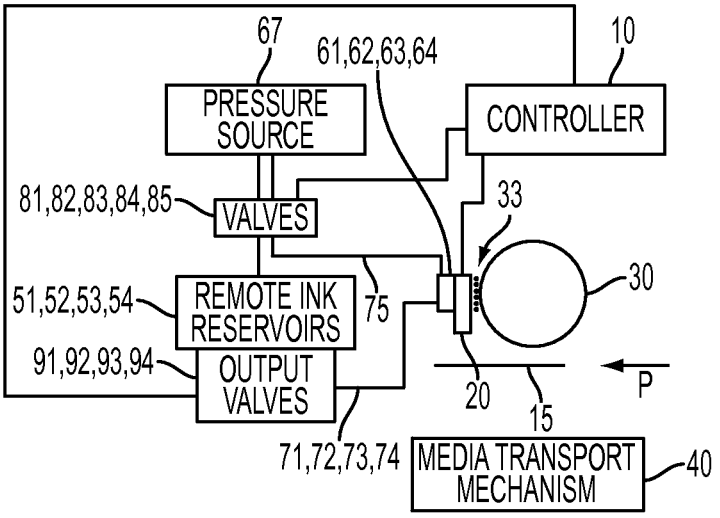
FIG. 6 PRIOR ART
FIG. 6 is a schematic block diagram of another embodiment of a prior art inkjet printing apparatus that includes on-board ink reservoirs.

FIGS. 5 and 6 are schematic block diagrams of embodiments of a previously known inkjet printing apparatus that includes a controller 10 and a printhead 20 that includes a plurality of inkjets for ejecting drops of ink 33 either directly onto a print output medium 15 (FIG. 5) or onto an intermediate transfer surface 30 before being transferred to media 15 (FIG. 6). The controller 10 operates the inkjets with reference to image data to form images on media 15 or surface 30 as the media or surface passes by the printhead 20. A medium transport mechanism 40 moves the medium in a process direction P. The printhead 20 receives ink from a plurality of on-board ink reservoirs 61, 62, 63, 64, which are attached to the printhead 20. The on-board ink reservoirs 61-64 respectively receive ink from a plurality of remote ink containers 51, 52, 53, 54 via respective ink supply channels 71, 72, 73, 74. Alternatively, the ink can come directly from the remote containers 51, 52, 53, 54 to the printhead 20 and reservoirs 61-64 are not incorporated in the printhead.

Although not depicted in FIG. 5 or 6, inkjet printing apparatus includes an ink delivery system for supplying ink to the remote ink containers 51-54. In one embodiment, the ink is an aqueous ink which is in liquid form at room temperature. However, in alternative embodiments, any suitable marking material or ink may be used, including, for example, phase-change ink, gel ink, oil-based ink, UV curable ink, or the like and may or may not need to be melted to achieve the correct properties for ejecting the ink.

The remote ink containers 51-54 are configured to deliver ink to the on-board ink reservoirs 61-64. In one embodiment, the remote ink containers 51-54 may be selectively pressurized, for example by compressed air that is provided by a pressure source 67 via a plurality of valves 81, 82, 83, 84. These values are operatively connected to the controller 10 to enable the controller to operate the valves as described below. The flow of ink from the remote containers 51-54 to the on-board reservoirs 61-64 may be under pressure or by gravity, for example. Output valves 91, 92, 93, 94 may be provided to control the flow of ink to the on-board ink reservoirs 61-64. These valves are also operatively connected to the controller 10 to enable operation of the valves by the controller. The pressure source may be configured to deliver air under pressure to the on-board reservoir at a plurality of different pressure levels. The plurality of pressure levels may be provided by using a variable speed air pump or by controlling valve 85 to bleed off pressure from the pressure supplied by the air pump until a desired pressure level is reached. As explained below, the plurality of pressure levels include at least a purge pressure and an assist pressure.

The on-board ink reservoirs 61-64 may also be selectively pressurized, for example, by selectively pressurizing the remote ink containers 51-54 and pressurizing an air channel 75 via a valve 85. Alternatively, the ink supply channels 71-74 may be closed, for example, by closing the output valves 91-94, and the air channel 75 may be pressurized. The on-board ink reservoirs 61-64 may be pressurized to perform a cleaning or purging operation on the printhead 20, for example. The on-board ink reservoirs 61-64 are vented to atmosphere during normal printing operation, for example, by controlling the valve 85 to vent the air channel 75 to atmosphere. The on-board ink reservoirs 61-64 may also be vented to atmosphere during non-pressurizing transfer of ink from the remote ink containers 51-54 (i.e., when ink is transferred without pressurizing the on-board ink reservoirs 61-64).

Figure 7:
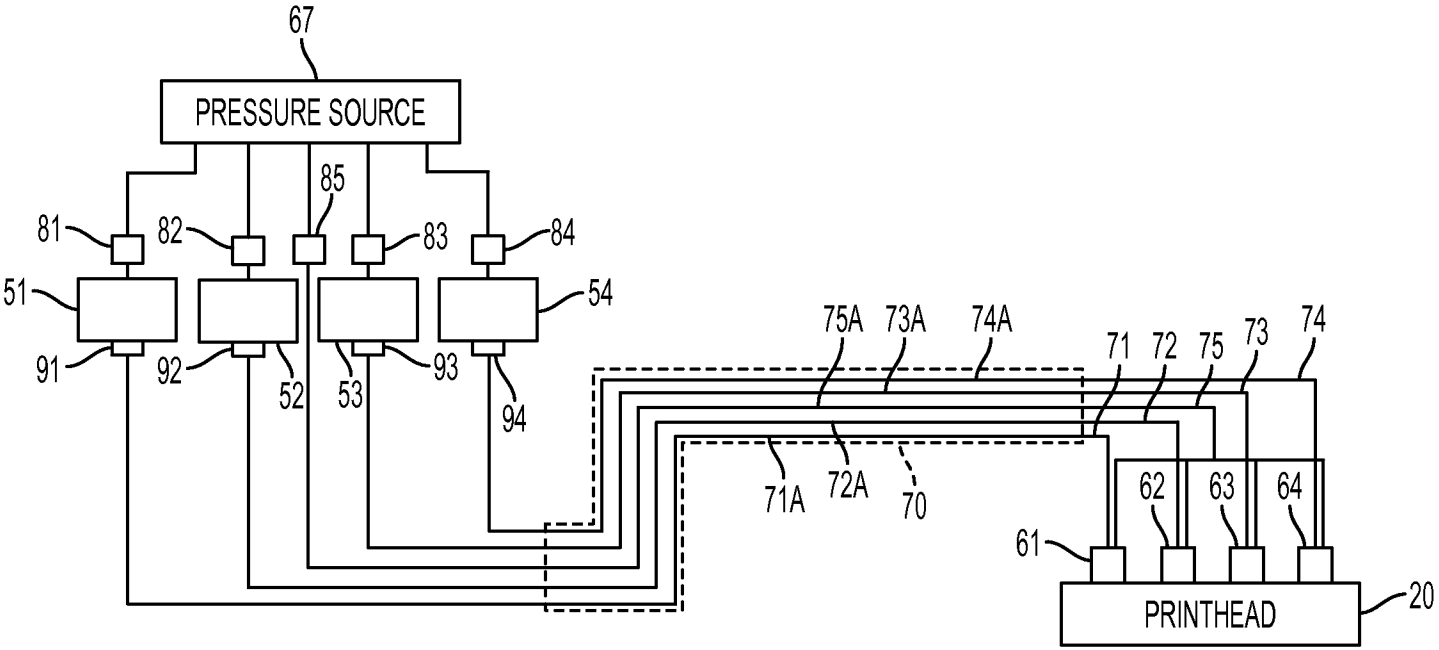
FIG. 7 PRIOR ART
FIG. 7 is a schematic block diagram of an embodiment of prior art ink delivery components of the inkjet printing apparatus of FIGS. 5 and 6.

As schematically depicted in FIG. 7, a portion of the ink supply channels 71-74 and the air channel 75 may be implemented as conduits 71A, 72A, 73A, 74A, 75A in a multi-conduit cable 70. Once pressurized ink reaches a printhead via an ink supply channel, it is collected in an on-board reservoir. The on-board reservoir is configured to communicate ink to an inkjet stack 100 that includes a plurality of inkjets (not shown) for ejecting the ink onto a print medium (FIG. 10) or an intermediate transfer member such as transfer drum 30 (FIG. 11).

One difficulty that occurs in fluid inkjet systems is inkjet contamination due to the introduction of air and other contaminants into the printhead that can cause poor print quality and even render the printhead inoperable. With reference to FIG. 1, a printhead and other components of an image forming device are shown that are configured to perform an air and debris prevention procedure to prevent air and other contaminants from entering the printhead, and further configured to perform a purge and wipe procedure to clean contaminated jets. The embodiment shown in FIG. 1 includes a printhead 20, such as the printhead 20 of FIGS. 10-12, can have at least one on-board reservoir 61, although it is not necessary, and an inkjet stack 100. The inkjet stack 100 can be formed in many ways, but in this example, it is formed of multiple laminated sheets or plates, such as stainless steel plates. Cavities etched into each plate align to form channels and passageways that define the inkjets and manifolds for the printhead. An outer plate comprises the aperture plate 104 that includes a plurality of apertures, which are shown in phantom in the aperture plate 104, corresponding to each inkjet through which drops of ink are ejected.

The embodiment of FIG. 1 further includes a receptacle 107, a scraper or wiper blade 108, an ink plate 109, and a controller 38. The controller 38 is operatively connected to the printhead 20 and the actuators 42, which are operatively connected to the receptacle 107, and the wiper 108, and the ink plate 109 to enable the controller 38 to operate the printhead and to move the ink plate, the receptacle, and the wiper. The actuators are configured to move components operatively connected to the actuators bi-directionally along axis B and axis A, which is substantially parallel to the front surface of the aperture plate.

To prevent air and other contaminants from entering the printhead, the embodiment of FIG. 1 is configured to help prevent printhead contamination from air and other debris by forming an ink layer between the aperture plate 104 of the printhead 20 and the ink plate 109. The ink layer overlies the nozzles of the inkjets and acts as a barrier to air and other contaminants. If a negative pressure occurs within the printhead, the ink from the ink layer, and not air or other contaminants, is drawn into the printhead.

In most embodiments having the plate 109, the receptacle 107 is moved opposite the printhead to catch ink wiped from the aperture plate during a purge ink maintenance operation, which is performed in a known manner to clear inoperative inkjets and remove debris and other contaminants from the aperture plate 104. If the printhead is going to remain out of service, such as when a maintenance procedure is performed during extended down time for the printer, the controller 38 operates the actuators 42 to move the ink plate 109 between the aperture plate 104 and the receptacle 107 to a position aligned with and spaced from the aperture plate 104 as shown in FIG. 1. At this position, the plate 109 covers the apertures of the aperture plate 104 at a predetermined distance from the aperture plate 104. After the ink plate 109 is so positioned with respect to the aperture plate 104, with reference to FIG. 2, the controller 38 operates a pressure source 67, such as those noted above, to produce positive pressure within the printhead 20 to urge ink through the apertures on the plate 104 and form an ink barrier or layer 111 between the ink plate 109 and the aperture plate 104. Alternatively, the ink may be ejected from the printhead 20 by operating the actuators in inkjets. The distance between the aperture plate 104 and the ink plate 109, and the amount of ink emitted from the printhead 20 is selected to ensure that the ink layer 111 forms a meniscus 113 along the perimeter of the ink layer between the aperture plate 104 and the ink plate 109. Thus, the presence of the plate 109 and the barrier 111 helps preserve the clean state of the aperture plate and the integrity of the inkjets following the purging procedure.

The meniscus 113 forms due to the surface tension of the ink layer 111 based on the amount of ink emitted, and the close proximity of the aperture plate 104 to the ink plate 109. The ink plate 109 can be as close as about 200 microns to the aperture plate 104 and as far as about six thousand microns to form the meniscus. Meniscus pressure ensures that the ink emitted from the printhead 20 that forms the ink layer 111 does not leak from the ink layer 111. The ink layer 111 encloses the apertures of the aperture plate 104 and prevents air and other debris from entering the apertures of the printhead. Even if a negative pressure is generated within the printhead, for example, during a printhead disconnect process, ink is drawn from the ink layer 111 into the printhead, rather than air and other debris. The ink helps attenuate the presence of foreign particles that can enter the apertures and contaminate the inkjets.

Figure 2:
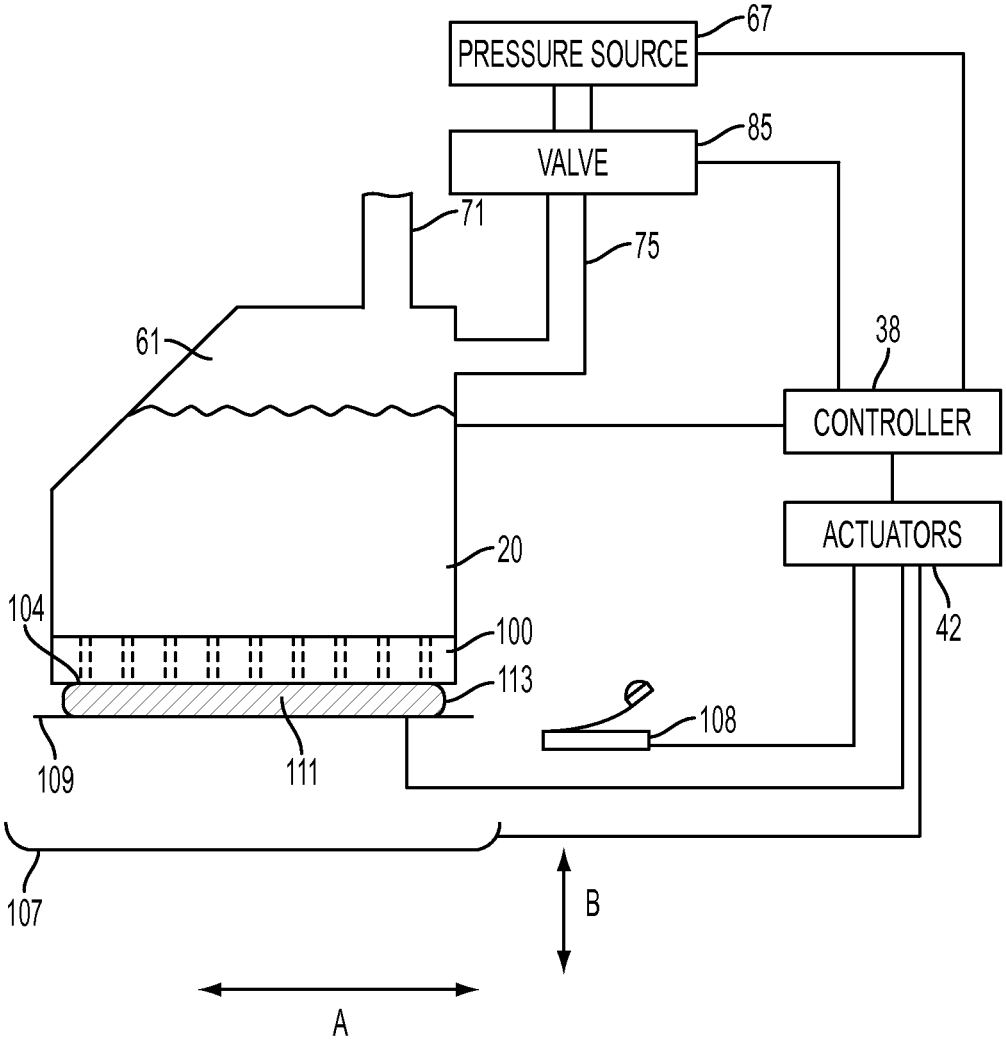
FIG. 2 is a simplified side cross-sectional view of an embodiment of the printhead positioned by a plate, receptacle and wiper blade of FIG. 1 depicting an ink layer with a meniscus formed between the aperture plate of the printhead and the plate.
Figure 3:
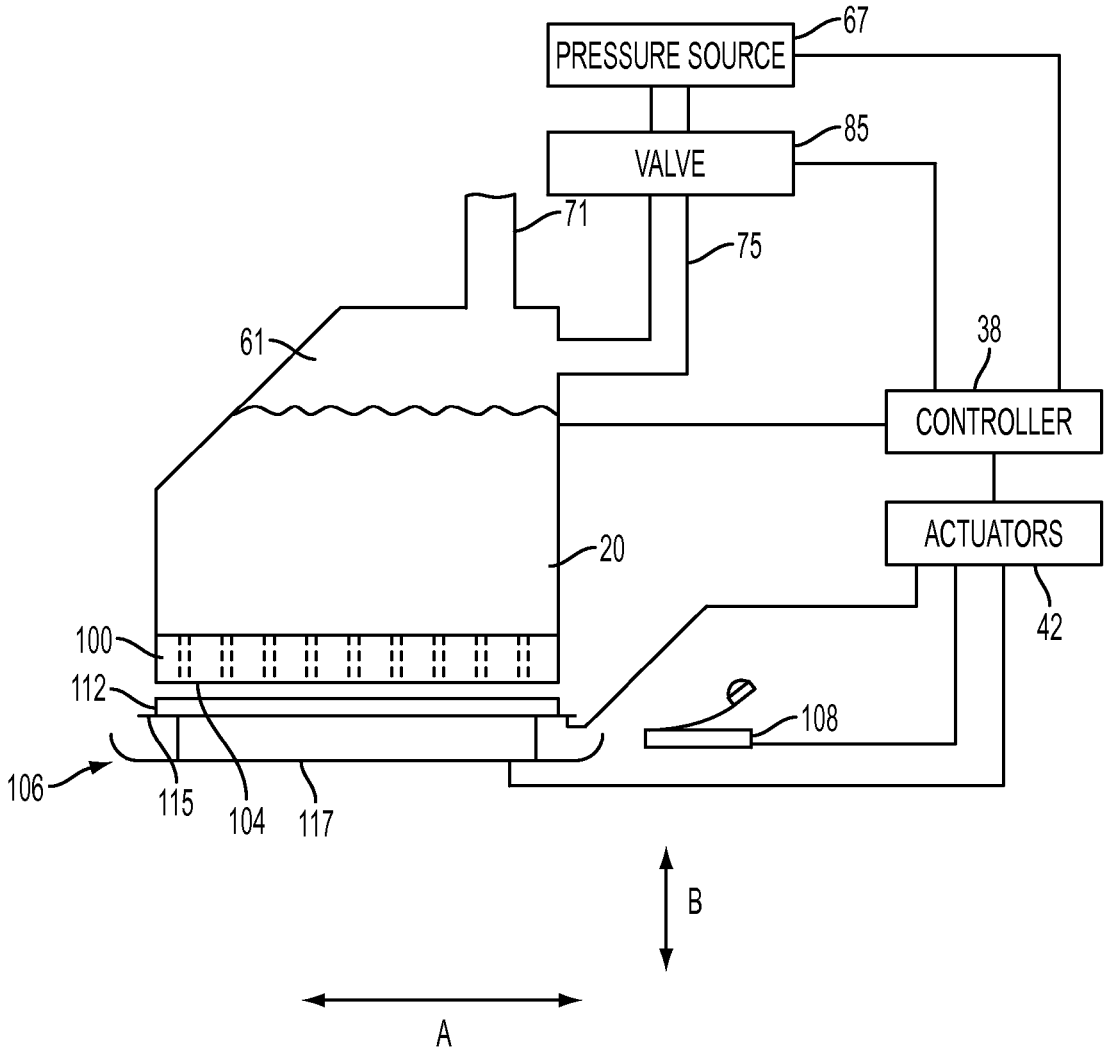
FIG. 3 is a simplified side cross-sectional view of an embodiment of a printhead positioned by a plate and receptacle assembly, and a wiper blade.

In the embodiment of the inkjet printing apparatus shown in FIGS. 1-2, the ink plate 109 is independent of the receptacle 107. In another embodiment, as depicted in FIG. 3, an ink plate 115 and a receptacle 117 are embodied together to form a maintenance assembly 106. In the maintenance assembly 106, the plate 115 is integrated with the receptacle 117 so it slides with reference to the receptacle. The controller 38 controls the actuators 42 to move the receptacle 117 of the maintenance assembly 106 opposite the printhead 20 to enable the receptacle 117 to receive ink from the face of the printhead 20 during the purging and wiping procedure. After the procedure is performed, the controller operates another actuator 42 to slide the ink plate 115 between the aperture plate 104 and the receptacle 107. The inkjets in the printhead can then be operated to form the ink barrier 111 with ink emitted from the printhead. In some embodiments of plate 115, a seal 112 is provided, as shown in FIG. 3. The seal 112 forms a perimeter on the plate 115 and the plate 115 is moved to press the seal 112 against the aperture plate 104. Thus, the seal 112 encloses the space in which ink is emitted to form the ink barrier 111, which helps prevent the printhead from being contaminated. When the printhead is to be returned to service for printing, actuator 42 is operated to withdraw the plate 115 and enable the ink barrier 111 to drop into the receptacle 117. Other actuators 42 can then be operated to move the receptacle 117 away from the printhead.

Figure 4:
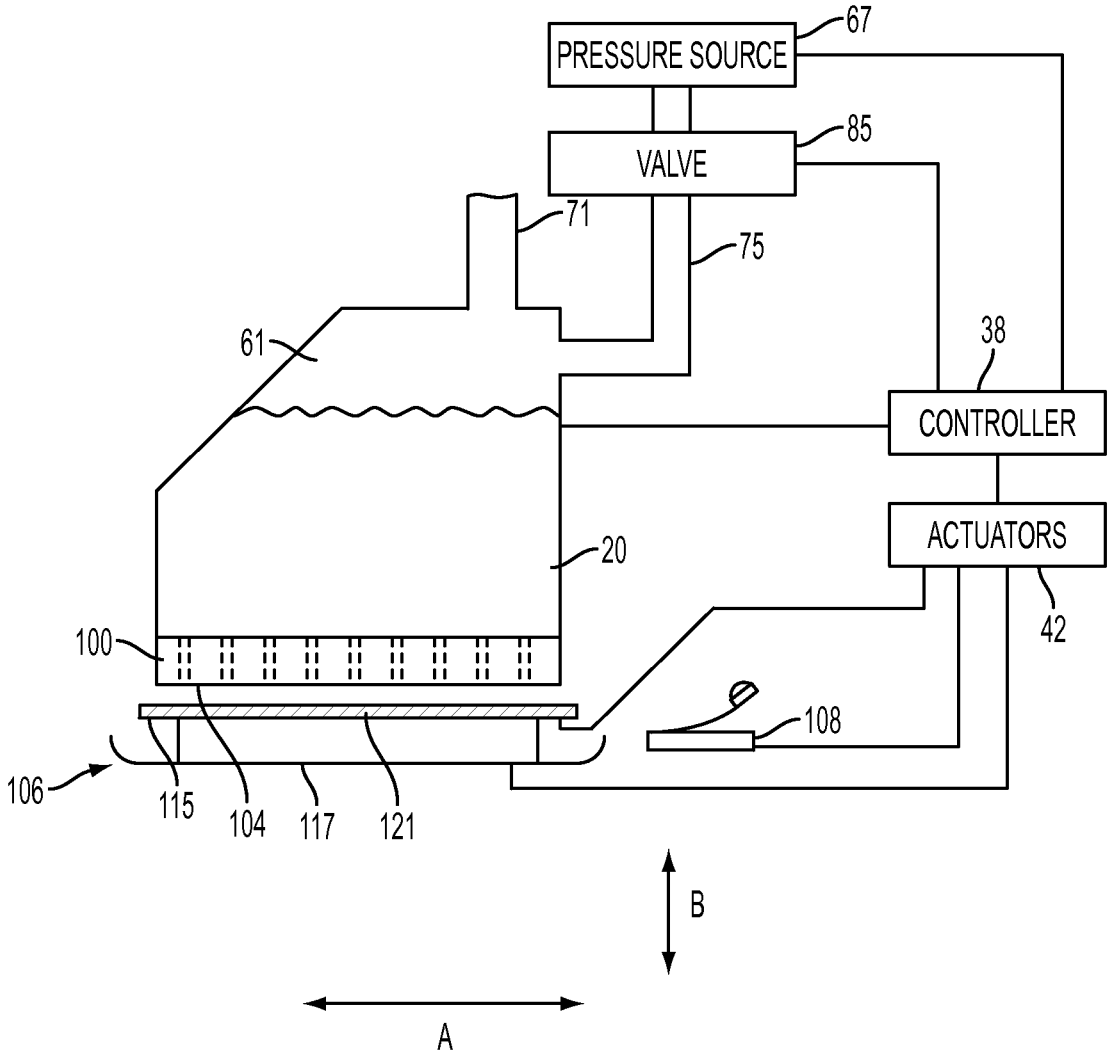
FIG. 4 is an illustration of a plate having an absorbent layer that is used to form an ink layer between a printhead and the plate.

In some embodiments, the plate 109 and 115 is a metal plate. In other embodiments, such as the one shown in FIG. 4, the ink plate has a foam layer 121, or other absorbent material or coating, to help hold the ink against the aperture plate 104. The absorbent layer is large enough to cover the footprint of the apertures on the aperture plate, but not so large as to exceed the perimeter of the receptacle beneath the plate. Also, the embodiments above are described with reference to a printhead that ejects liquid ink, such as an aqueous ink. The ink barrier plate could be used in printers that use phase change inks provided that either the plate or the printhead or both are heated to maintain the ink in the liquid phase. Otherwise, the ink would solidify between the plate and the printhead and leave a layer of solid ink on the printhead face, which is not desirable.

While positioning the receptacle 107 or 117 or the ink plate 109 or 115 has been described with reference to controlling actuators to move the components with respect to stationary printheads, other embodiments are contemplated. In one embodiment, both the printhead and the components are controlled to be moved with respect to each other in order to position the components with respect to the printhead. In yet another embodiment, only the printhead is controlled to be moved into position with respect to the components, while the components remain stationary except the plate and the receptacle move relative to one another to enable the purging and wiping procedure with the receptacle alone and the ink barrier formation to occur with both structures being opposite the printhead. In one particular such embodiment, one or more of the components are mounted within the printer and not connected to actuators. In another such embodiment, one or more of the components remain connected to and moveable by the actuators.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a printhead including an aperture plate defining a plurality of apertures, the printhead configured to emit liquid ink through the plurality of apertures of the aperture plate;

a plate positioned with reference to the aperture plate to enable a liquid ink layer to form between the plate and the aperture plate with ink emitted from the printhead;

a pressure source operatively coupled to the printhead;

a receptacle;

an actuator operatively connected to the plate; and a controller operatively connected to the printhead, the actuator, and the pressure source, the controller being configured to operate the printhead to emit the liquid ink to the plate to form the liquid ink layer, to operate the pressure source to pressurize ink within the printhead and emit ink from the apertures in the aperture plate, and to operate the actuator and move the plate to cover the receptacle selectively.

2. The imaging device of claim 1, the controller being further configured to:

operate the printhead to emit an amount of ink from the printhead to the plate and a distance between the plate and the aperture plate is selected to enable the liquid ink to form the liquid ink layer without leaking from between the aperture plate and the plate.

3. The imaging device of claim 2, the controller being further configured to:

operate the printhead to emit an amount of ink ejected to the plate and the distance between the plate and the aperture plate is selected to enable surface tension of the liquid ink layer to form a meniscus about a perimeter of the liquid ink layer between the aperture plate and the plate.

4. The imaging device of claim 1, the controller being further configured to operate the actuator and move the plate with reference to the aperture plate to enable formation of the ink layer between the plate and the aperture plate.

5. The imaging device of claim 1, the controller being further configured to:

operate the printhead to eject the liquid ink from the printhead to form the liquid ink layer.

6. The imaging device of claim 1 further comprising:

a wiper blade;

another actuator operatively connected to the wiper blade; and the controller is operatively connected to the other actuator, the controller being further configured to operate the other actuator and move the wiper blade to wipe ink from a portion of the aperture plate before operating the actuator operatively connected to the plate to cover the receptacle.

7. The imaging device of claim 1, the plate further comprising:

a seal positioned along a perimeter on the plate.

8. The imaging device of claim 1, the plate further comprising:

an absorbent layer mounted to the plate.

9. A method of imaging device operation comprising:

positioning at least one of a printhead and a plate having a seal along a perimeter of the plate with reference to each other at a distance to enable an ink layer to be formed between an aperture plate of the printhead and the plate with liquid ink emitted by the printhead; and operating with a controller the printhead to emit liquid ink through a plurality of apertures defined in the aperture plate of the printhead to the plate to form the ink layer between the plate and the aperture plate.

10. The method of imaging device operation of claim 9, the positioning at least one of the printhead and the plate comprises:

positioning at least one of the printhead and the plate such that the distance between the aperture plate and the plate enables the liquid ink emitted by the printhead to the plate to form the ink layer without leaking from between the aperture plate and the plate.

11. The method of imaging device operation of claim 10, the positioning at least one of the printhead and the plate comprises:

positioning at least one of the printhead and the plate such that the distance between the aperture plate and the plate enables the liquid ink emitted by the printhead to the plate to form the ink layer with a meniscus about a perimeter of the ink layer between the aperture plate and the plate.

12. The method of imaging device operation of claim 9, the positioning at least one of the printhead and the plate comprises:

operating with the controller an actuator operatively connected to at least one of the printhead and the plate to move at least one of the printhead and the plate with respect to each other.

13. The method of imaging device operation of claim 9, the operating the printhead with the controller to emit liquid ink comprises:

operating the printhead with the controller to eject liquid ink to form the ink layer.

14. The method of imaging device operation of claim 9, further comprising:

operating with the controller a pressure source operatively connected to the printhead to pressurize ink within the printhead to emit ink from the plurality of apertures in the aperture plate.

15. The method of imaging device operation of claim 14, further comprising:

operating with the controller an actuator operatively connected to the plate to move the plate to cover a receptacle selectively.

16. The method of imaging device operation of claim 15, further comprising:

operating with the controller an actuator operatively connected to at least one of the printhead and a wiper blade to move at least one of the printhead and the wiper blade with reference to each other to enable the wiper blade to wipe ink from the aperture plate before operating the actuator operatively connected to the plate to move the plate to cover the receptacle selectively.

17. A method of imaging device operation comprising:

positioning at least one of a printhead and a plate having an absorbent layer mounted to the plate with reference to each other at a distance to enable an ink layer to be formed between an aperture plate of the printhead and the plate with liquid ink emitted by the printhead; and operating with a controller the printhead to emit liquid ink through a plurality of apertures defined in the aperture plate of the printhead to the plate to form the ink layer between the plate and the aperture plate.

* * * * *